US010695900B2

(12) United States Patent
Robert

(10) Patent No.: US 10,695,900 B2
(45) Date of Patent: Jun. 30, 2020

(54) ERGONOMIC AND ELEVATED WORK SURFACE AND A TABLE TOP WORK BENCH

(71) Applicant: Etablee LLC, Laguna Hills, CA (US)

(72) Inventor: Vincent Robert, Woodside, NY (US)

(73) Assignee: Etablee LLC, Laguna Hills, CA (US)

( * ) Notice: Subject to any disclaimer, the term of this patent is extended or adjusted under 35 U.S.C. 154(b) by 114 days.

(21) Appl. No.: 15/950,020

(22) Filed: Apr. 10, 2018

(65) Prior Publication Data

US 2018/0297191 A1 Oct. 18, 2018

Related U.S. Application Data

(60) Provisional application No. 62/484,727, filed on Apr. 12, 2017.

(51) Int. Cl.

| | |
|---|---|
| ***B25H 1/04*** | (2006.01) |
| ***B25H 1/00*** | (2006.01) |
| ***B25H 1/16*** | (2006.01) |
| ***B25H 1/06*** | (2006.01) |
| ***A47B 13/10*** | (2006.01) |

(52) U.S. Cl.

CPC ..... *B25H 1/04* (2013.01); *A47B 13/10* (2013.01); *B25H 1/005* (2013.01); *B25H 1/06* (2013.01); *B25H 1/16* (2013.01)

(58) Field of Classification Search

CPC ..... A47B 3/06; A47B 13/003; A47B 13/10; A47B 17/00; A47B 27/00; A47B 2200/0001; A47B 2037/005; B25H 1/00; B25H 1/04; B25H 1/005; B25H 1/06

See application file for complete search history.

(56) References Cited

U.S. PATENT DOCUMENTS

| | | | | |
|---|---|---|---|---|
| D315,463 | S * | 3/1991 | Spiegel | D12/133 |
| D426,409 | S * | 6/2000 | Clark | D6/406.5 |
| D679,921 | S * | 4/2013 | Kiechler | D6/406.5 |
| D778,653 | S * | 2/2017 | Spoelhof | D6/707.22 |
| 2003/0177957 | A1* | 9/2003 | Ibrahim | A47B 21/0314 108/6 |
| 2011/0001339 | A1* | 1/2011 | Krueger | A47B 13/021 297/135 |
| 2015/0083027 | A1* | 3/2015 | Martin | A47B 9/18 108/1 |

* cited by examiner

*Primary Examiner* — Tyrone V Hall, Jr.

(74) *Attorney, Agent, or Firm* — Merek, Blackmon & Voorhees, LLC

(57) ABSTRACT

An ergonomic and elevated work surface/top and a work bench having the same. The ergonomic work surface can be maintained in an elevated position by one or more legs, one or more supports (e.g., brackets) attached to a wall or other vertical support or one or more supports extending downwardly from a ceiling or other raised horizontal support. Preferably, the elevated and ergonomic work surface/top is sturdy, rigid and has little or no flex and brings object(s) supported thereby closer to the user's face eliminating or significantly reducing the user leaning over to a position not conducive to proper posture. The top includes contoured/curved/angled sections that provide comfortable and versatile resting surfaces allowing an individual to rest both of his or her arms on for prolong periods without experiencing soreness or other undesirable consequences. The work bench can be portable, collapsible and removably mounted on a primary work structure.

18 Claims, 13 Drawing Sheets

ERGONOMIC AND ELEVATED WORK SURFACE AND A TABLE TOP WORK BENCH

RELATED PATENT APPLICATION

The subject patent application claims priority under 35 USC § 119(e) from Provisional Patent Application Ser. No. 62/484,727 filed on Apr. 12, 2017 the entire contents of which is incorporated herein by reference.

FIELD OF THE INVENTION

Preferred forms of the present invention include an ergonomic and elevated work surface/top and a work bench having the elevated and ergonomic work surface/top. The ergonomic work surface can be maintained in an elevated position by one or more legs, one or more supports (e.g., brackets) attached to a wall or other vertical support structure or one or more supports extending downwardly from a ceiling or other raised horizontal support structure. The preferred form of the elevated and ergonomic work surface/top is sturdy, rigid and has little or no flex when used by an individual. The preferred form of the elevated and ergonomic work surface/top brings an object or objects supported thereby closer to the user's face and eliminates or significantly reduces the user leaning over to a position that is not conducive to proper posture while working on the object or objects. The top includes contoured/curved/angled sections that provide comfortable and versatile resting surfaces allowing an individual to rest both of his or her arms on for prolong periods without experiencing soreness or other undesirable consequences. The contoured/curved/angled sections also avoid any portion of a user's arm from resting against a sharp or pointed edge of a work surface. The work bench can be portable and collapsible. The work bench can also be configured to be removably mounted on a primary work structure (e.g., desk, table, etc.).

BACKGROUND OF THE INVENTION

Traditional and special use tables do not provide the user with an ergonomic contact surface and/or work surface. For example, the typical height of these structures is not conducive to the user having proper posture while working on one or more objects. Rather, these structures typically require the user to lean over the work surface of the structure to a work position that cannot be maintained for prolonged periods without the user experiencing soreness or other undesirable consequences. Additionally, known adjustable height tables have significant inherent disadvantages including lack or ease of portability and complex/cumbersome components necessary to adjust the height of the work surface. Typical dedicated raised surface work benches are single application in use. They take up considerable space, are highly specialized to a single task, expensive, and cannot be easily transported. The adjustable height tables are also bulky, not easily transported, and have moving parts which can fail. Also, there is no ergonomic contact surface and/or work surface.

OBJECTS AND SUMMARY OF THE INVENTION

An object of a preferred form of the present invention is to a novel and unobvious an elevated and ergonomic work surface/top having contoured/curved/angled sections that provide comfortable and versatile resting surfaces allowing an individual to rest both of his or her arms on for prolong periods without experiencing soreness or other undesirable consequences.

Another object of a preferred form of the present invention is to provide a portable secondary/auxiliary work structure (e.g., auxiliary/secondary work bench) assembly that is configured to be mounted on top of a primary/main work structure assembly (e.g., table, desk, work bench, etc.).

Still another object of a preferred form of the present invention is to provide a portable secondary/auxiliary work structure having a top forming a raised work surface that is lightweight, sturdy, rigid and has little or no flex when used by an individual.

A further object of a preferred form of the present invention is to provide an elevated and ergonomic work surface/top forming a raised work surface wherein the top includes a front, left section and a front, right section that extend downwardly from a horizontal plane to allow comfortable and versatile resting surfaces for the user's left and right arms, respectively.

Still another object of a preferred embodiment of the present invention is to provide an elevated and ergonomic work surface/top forming a raised work surface wherein the top includes a left front section and a right front section that extend downwardly from a first horizontal plane and a front intermediate section disposed between the left and right front sections and a rearward section that extends the width of the top wherein the intermediate section and the rearward section have an uppermost surface which extends in the first horizontal plane.

Still a further object of a preferred embodiment of the present invention is to provide a portable secondary/auxiliary work structure having a top formed from hand laid carbon fiber to form a top that is lightweight, sturdy, rigid and has little or no flex when used by an individual.

A further object of a preferred form of the present invention is to provide an elevated and ergonomic work surface/top forming a raised work surface wherein the top includes a left front section and a right front section that extend downwardly at an acute angle from a horizontal plane wherein the acute angle varies over the width of each of the left front section and right front right section.

Another object of a preferred form of the present invention is to provide a portable secondary/auxiliary work structure having a pair of legs detachably connected to a top forming a raised work surface wherein each of the legs are lightweight, sturdy and have one or more honeycomb sections to maximize the strength of each leg.

Still a further object of the present invention is to provide a portable secondary/auxiliary work structure having a pair of legs detachably connected to a top forming a raised work surface wherein each leg includes a front section having upper and lower feet, a rear section having upper and lower feet and an intermediate section connecting the front section to the rear section wherein the front section and the rear section extend parallel to each other and the intermediate section extends at an angle to said front section and said rear section and further wherein the upper foot of the front section extends at an acute angle to a horizontal plane and the upper foot of the rear section extends parallel to the horizontal plane.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention. Further, the above is not an exhaustive list of the advantages and objects of the preferred forms of the present invention. Other advantages and objects of preferred forms of the present invention will be readily appreciated from the description of the preferred forms of the present invention.

In summary, one preferred embodiment of the present invention is directed to an apparatus for supporting one or more objects in an elevated position that allows a user to access and work on the one or more objects. The apparatus includes a top forming an elevated work surface accessible to a user. The top includes a front section, a rear section, a left side and a right side. The front section has a left portion, an intermediate portion and a right portion. The intermediate portion is disposed between the left portion and the right portion. The intermediate portion forms a first portion of a front edge of the top. The left portion of the front section forms a second portion of the front edge of the top and a front portion of the left side of the top and the right portion of the front section forms a third portion of the front edge of the top and a front portion of the right side of the top. An upper surface of the intermediate portion of the front section of the top is disposed in a first horizontal plane. An upper surface of the rear section of the top surface is disposed in the first horizontal plane. The left portion of the front section of the top and the right portion of the front section of the top each extend downwardly at an angle to the first horizontal plane to provide a resting surface for a corresponding portion of an individual's arm.

Another preferred embodiment of the present invention is directed to a portable work bench configured to be removably mounted on a work surface of a primary work apparatus having one or more legs for supporting the work surface of the primary work apparatus in a raised position. The portable work bench includes a top forming an elevated work surface offset upwardly from the work surface of the primary work apparatus. The top includes a front section, a rear section, a left side and a right side. The front section of the top has a left portion, an intermediate portion and a right portion. The intermediate portion is disposed between the left portion and the right portion. An upper surface of the intermediate portion of the front section of the top is disposed in a first horizontal plane. The left portion of the top and the right portion of the top each extend downwardly from the first horizontal plane to provide a resting surface for a corresponding portion of an individual's arm. At least one leg removably supports the top of the portable work bench on the work surface of the primary work apparatus. The at least one leg of the portable work bench has a height less than a height of each of the one or more legs of the primary work apparatus.

A further embodiment of the present invention is directed to a portable work bench configured to be removably mounted on a work surface of a primary work apparatus having one or more legs for supporting the work surface of the primary work apparatus in a raised position. The portable work bench includes a top forming an elevated work surface offset upwardly from the work surface of the primary work apparatus. The top including a front section, a rear section, a left side and a right side. The front section of the top has a left portion, an intermediate portion and a right portion. The intermediate portion is disposed between the left portion and the right portion. The intermediate portion of the front section of the top is disposed in a first horizontal plane. The left portion of the top and the right portion of the top each extend downwardly from the first horizontal plane to provide a resting surface for a corresponding portion of an individual's arm. At least two legs removably support the top of the portable work bench on the work surface of the primary work apparatus. The at least two legs of the portable work bench are detachably connected to the portable work bench so that the portable work bench can be collapsed.

The above summary describes preferred forms of the present invention and is not in any way to be construed as limiting the claimed invention to the preferred forms.

DETAILED DESCRIPTION OF THE PREFERRED EMBODIMENTS OF THE INVENTION

Figure 1:
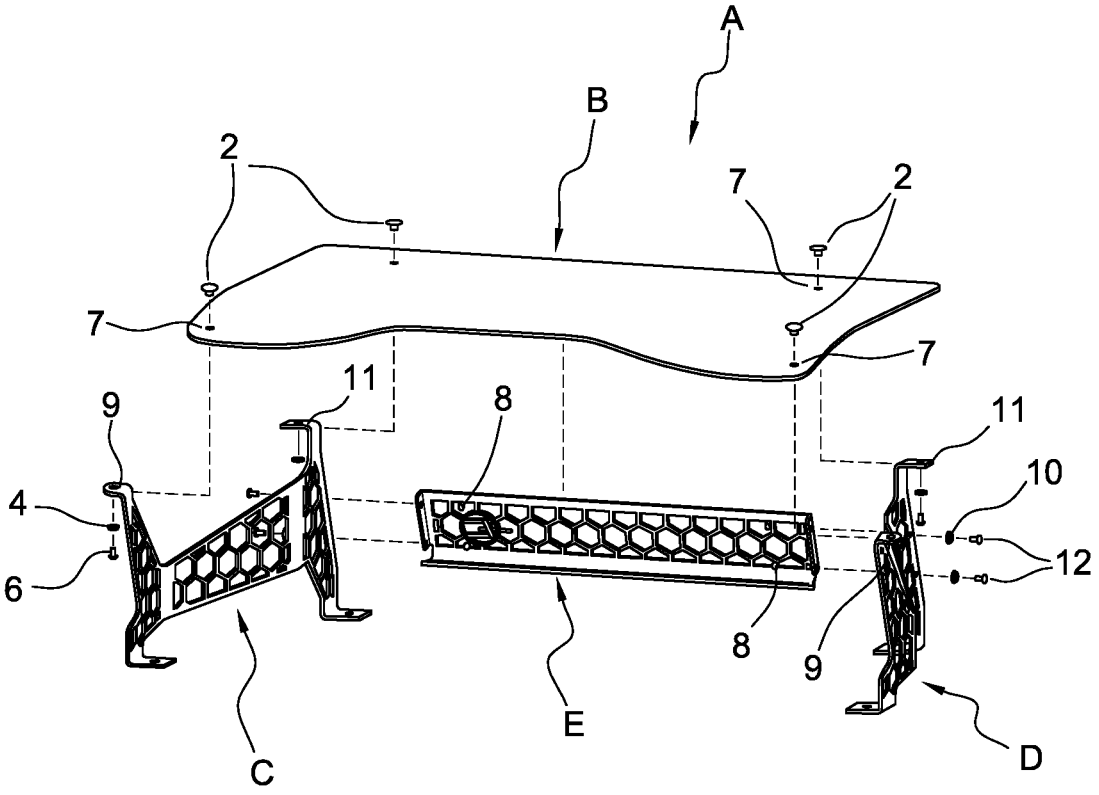
FIG. 1 is an exploded front view of a preferred form of the present invention.
Figure 2:
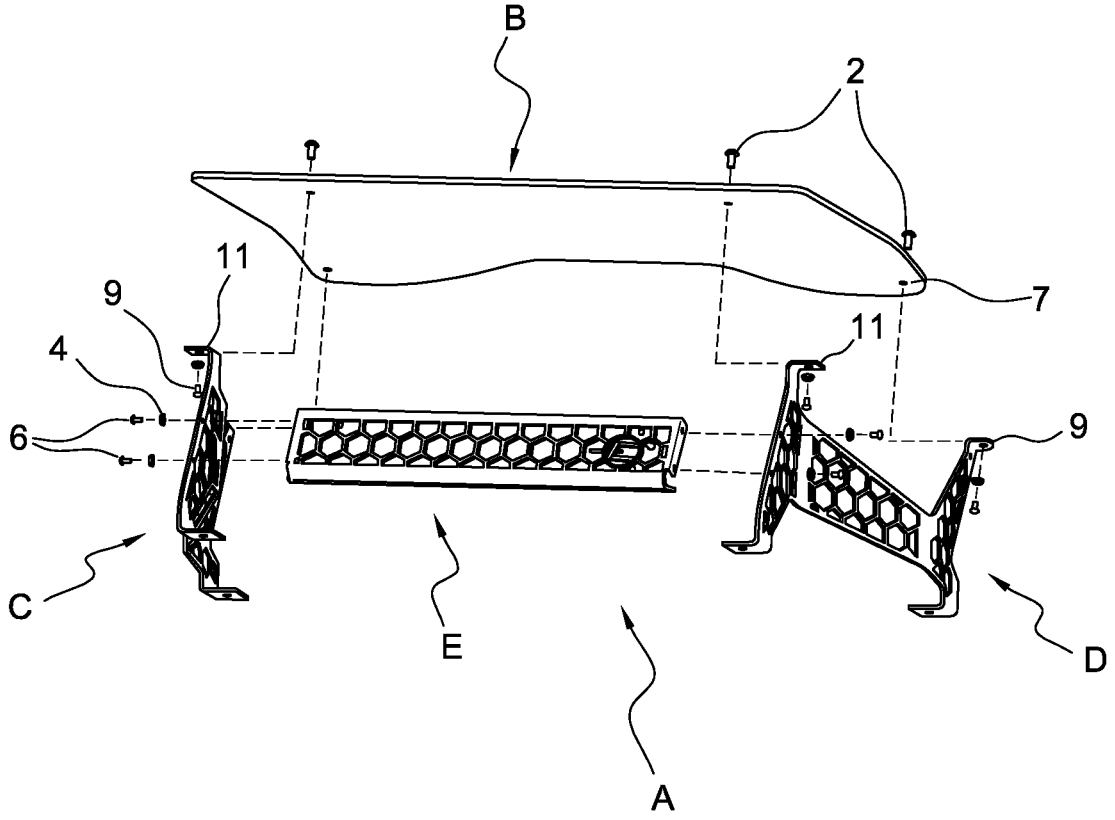
FIG. 2 is an exploded rear view of the preferred form of the present invention depicted in FIG. 1.
Figure 3:
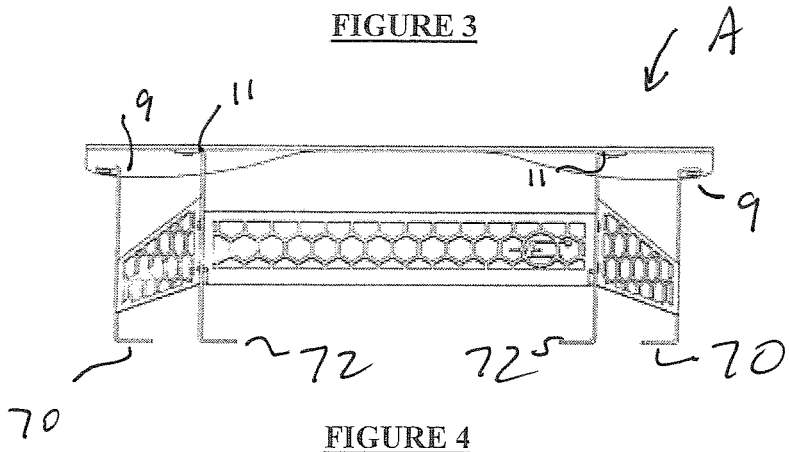
FIG. 3 is a rear elevational view of the preferred form of the present invention depicted in FIG. 1.
Figure 4:
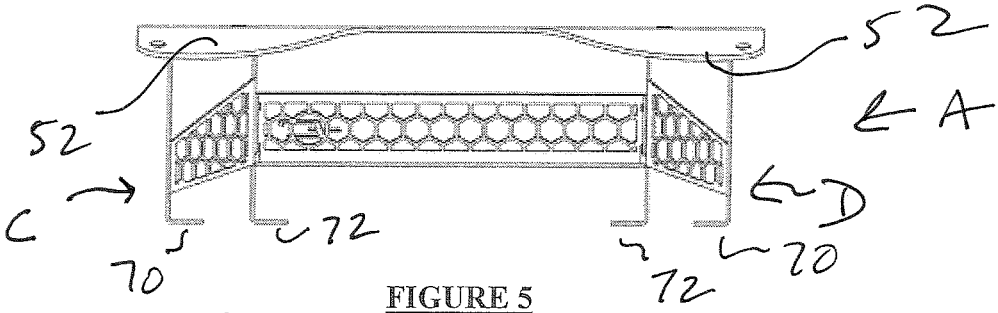
FIG. 4 is a front elevational view of the preferred form of the present invention depicted in FIG. 1.
Figure 5:
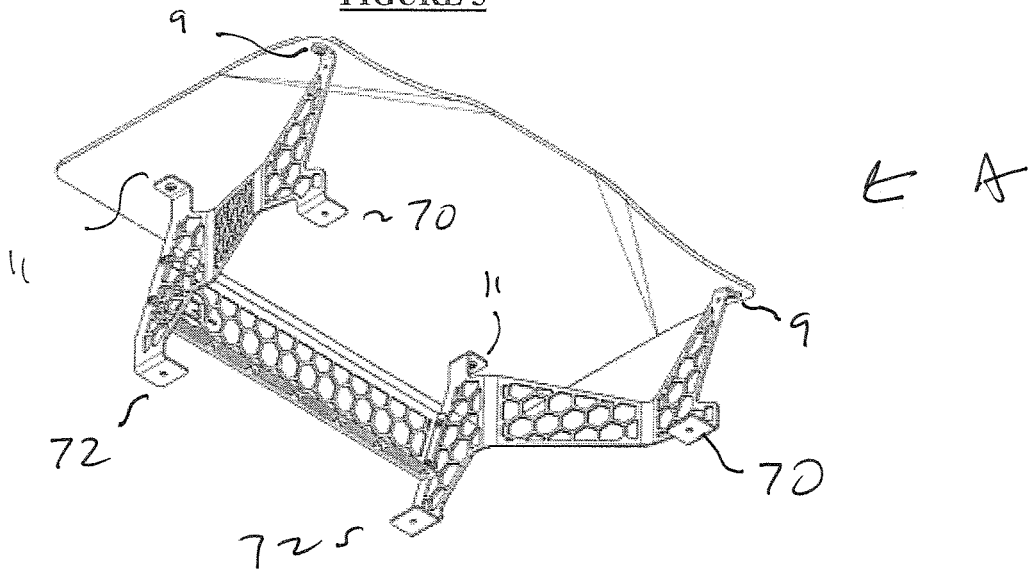
FIG. 5 is a bottom perspective view of the preferred form of the present invention depicted in FIG. 1.
Figure 6:
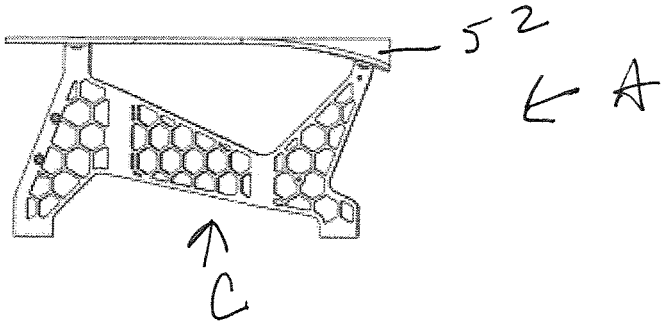
FIG. 6 is a left side elevational view of the preferred form of the present invention depicted in FIG. 1.
Figure 7:
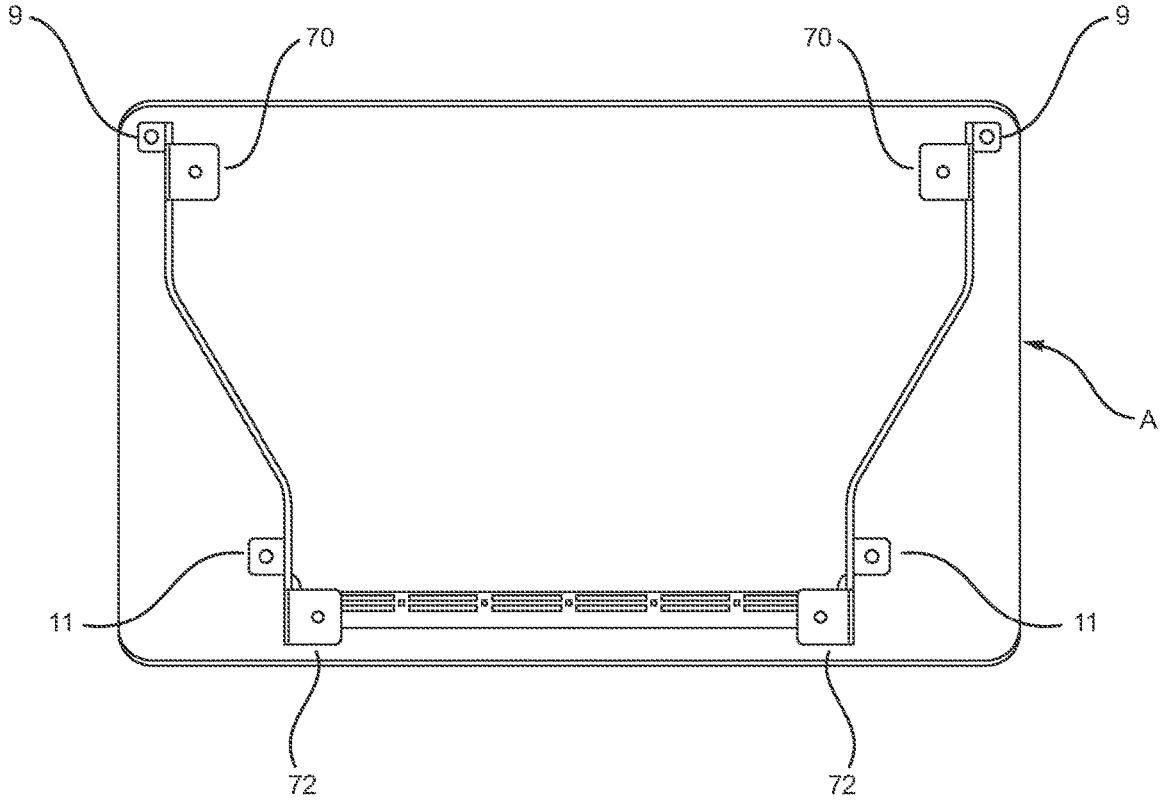
FIG. 7 is a bottom view of the preferred form of the present invention depicted in FIG. 1.
Figure 8:
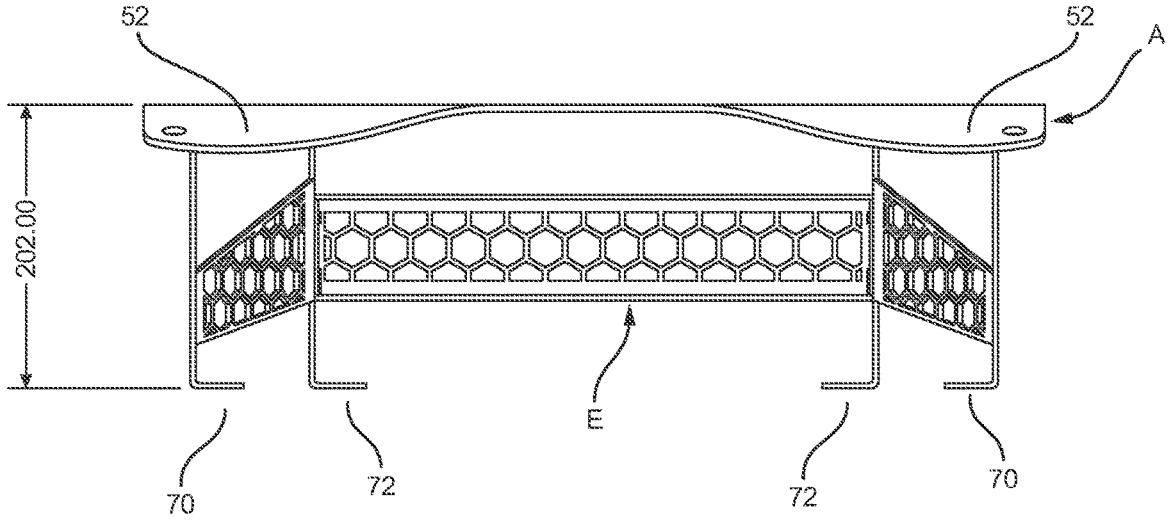
FIG. 8 is a front elevational view of the preferred form of the present invention depicted in FIG. 1 showing in millimeters one preferred dimension.
Figure 9:
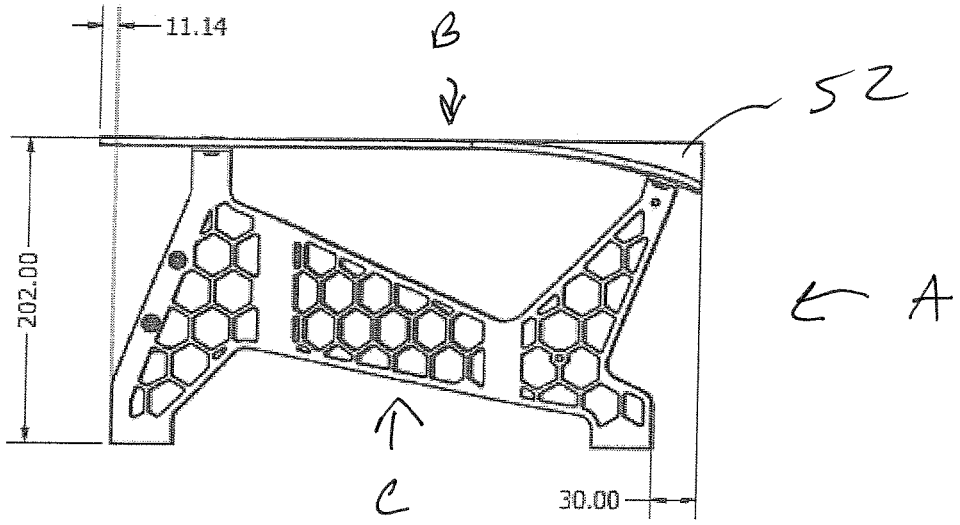
FIG. 9 is a left side elevational view of the preferred form of the present invention depicted in FIG. 1 showing in millimeters several preferred dimensions.

The preferred forms of the invention will now be described with reference to FIGS. 1-22. The appended claims are not limited to the preferred forms and no term and/or phrase used herein is to be given a meaning other than its ordinary meaning unless it is expressly stated otherwise. The dimensions illustrated in various figures are preferred dimensions. Any of the illustrated preferred dimensions may be varied as desired. It is noted that the linear dimensions (e.g., length, width and height) illustrated in the various drawings are in millimeters.

FIGS. 1 Through 22

Referring to FIGS. 1 to 22, a portable table top work bench A employing a preferred form of the invention is illustrated in one of many possible configurations. Work bench A includes an ergonomic top/work surface B. Preferably, work bench A is detachably connected to left leg C and right leg D. A rear support E is detachably connected to and extends between left leg C and right leg D. Work bench A can be removably mounted on or permanently fixed to a work surface of a primary work structure F (e.g., table, desk, etc.). Further, while work bench A is shown removably mounted on a work surface of a primary work structure F (e.g., table, desk, etc.) in FIG. 22, it is to be understood that ergonomic work surface/top B can form the top of the primary work structure F. Further, ergonomic work surface/top B can be used without either of legs C and D and/or without rear support E. Further, ergonomic work surface/top B can be maintained in an elevated position by one or more legs, one or more supports (e.g., brackets) attached to a wall or other vertical support structure or one or more supports (e.g., cable, wire, etc.) extending downwardly from a ceiling or other raised horizontal support structure.

Ergonomic work surface/top B preferably is sturdy, rigid and has little or no flex when used by an individual. Ergonomic work surface/top B can be formed from hand laid carbon fibers which are interwoven. However, any suitable material can be used to form top B. Preferably, legs C and D and rear support E are formed from aluminum and have one or more honeycomb shaped sections to minimize weight while maximizing strength. However, legs C and D and rear support E can be formed from any suitable material.

In the preferred form, work bench A includes female inserts 2, conical washers 4 and star screws 6 to detachably connect each of the upper feet of legs C and D to ergonomic top A. An example of a suitable star screw 6 are screws sold under the trademark TORX®. Openings 7 are preferably formed in top B to facilitate connection of top B to legs C and D by receiving corresponding portions of female inserts 2 and star screws 6. However, it is to be understood that any suitable fastener or connecting device or substance may be used to connect top B to legs C and D. Legs C and D each have an upper front foot 9 and an upper rear foot 11. Each of the upper feet of each of legs C and D preferably has an opening 13 to facilitate connection of top B to legs C and D by receiving corresponding portions of female inserts 2 and star screws 6.

Figure 14:
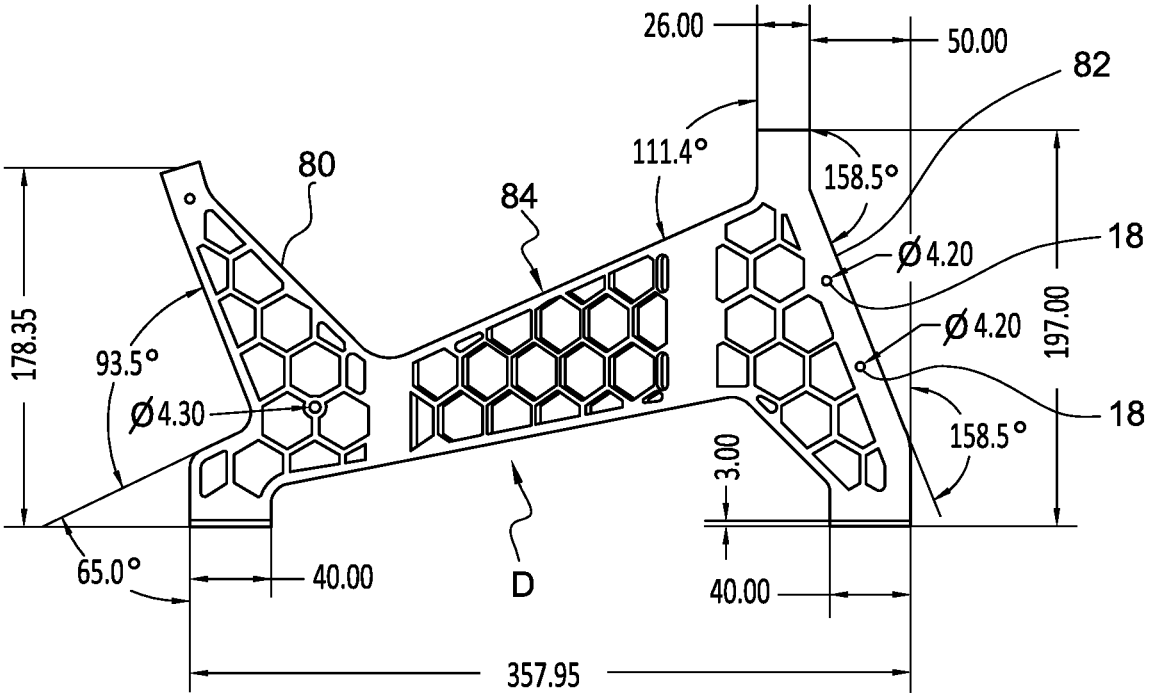
FIG. 14 is a side elevational view of a preferred form of the left leg showing several preferred dimensions.
Figure 15:
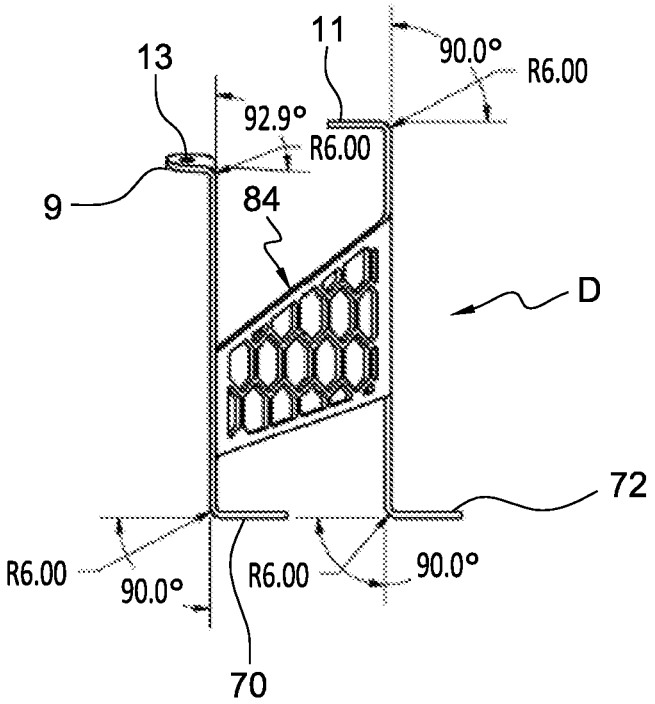
FIG. 15 is a front elevational view of a preferred form of the left leg showing several preferred dimensions.
Figure 17:
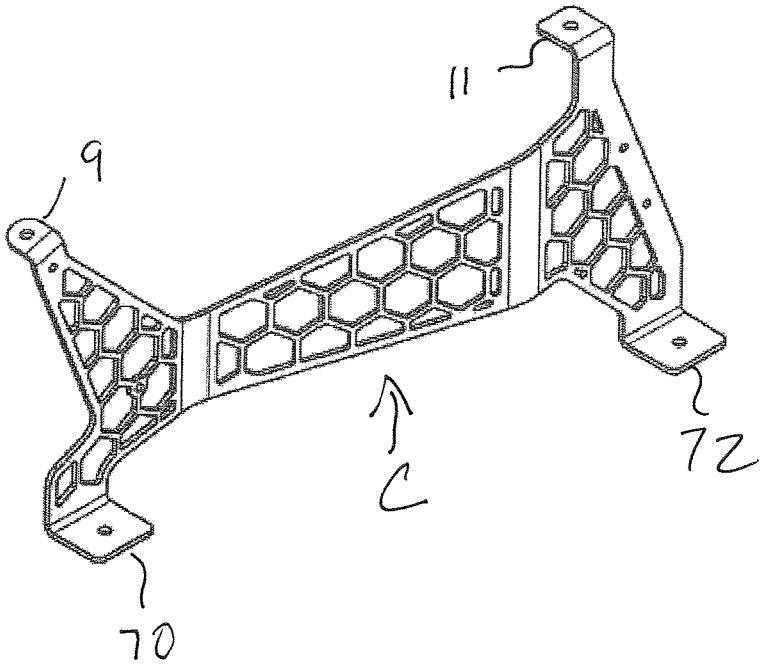
FIG. 17 is a perspective view of a preferred form of the right leg.
Figure 18:
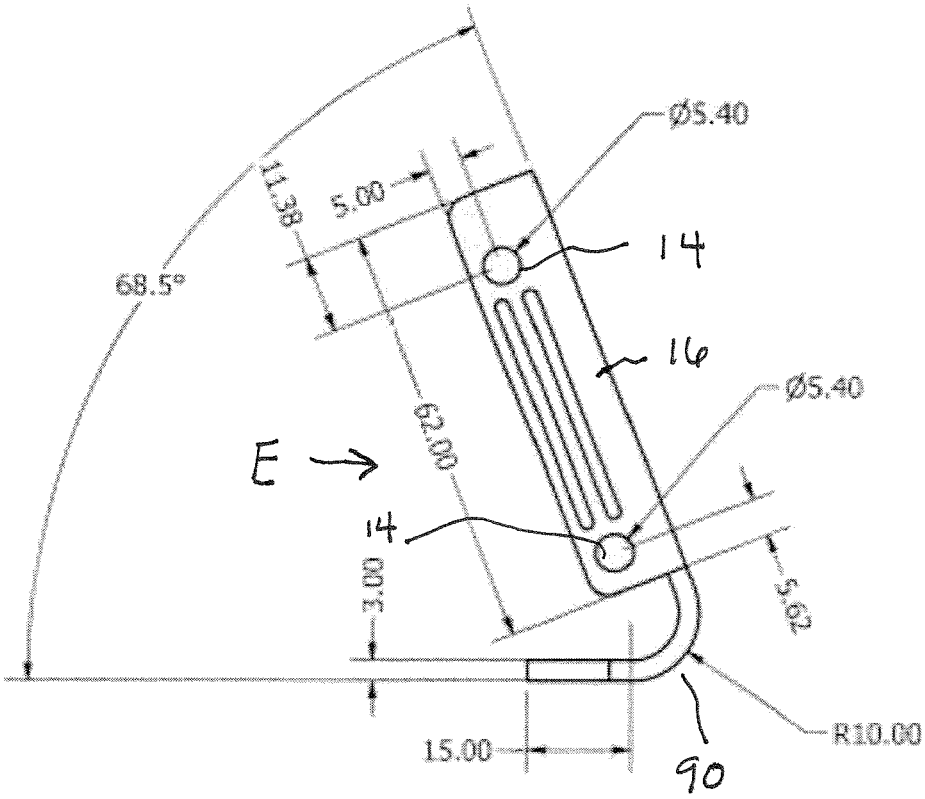
FIG. 18 is a side elevational view of a preferred form of rear support connected to and extending between the left and right legs showing several preferred dimensions.
Figure 19:
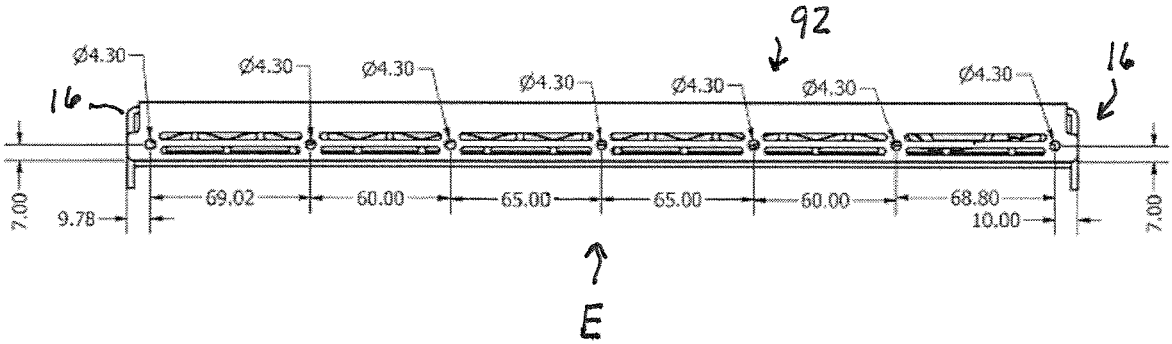
FIG. 19 is a front view of the rear support depicted in FIG. 18 showing several preferred dimensions.
Figure 20:
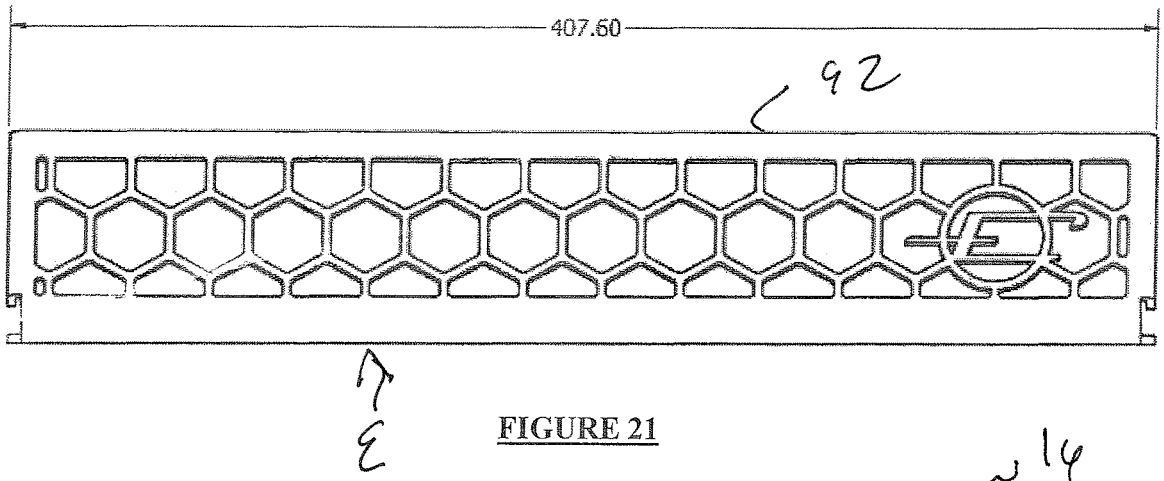
FIG. 20 is a front view of the rear support depicted in FIG. 18 showing one preferred dimension.
Figure 21:
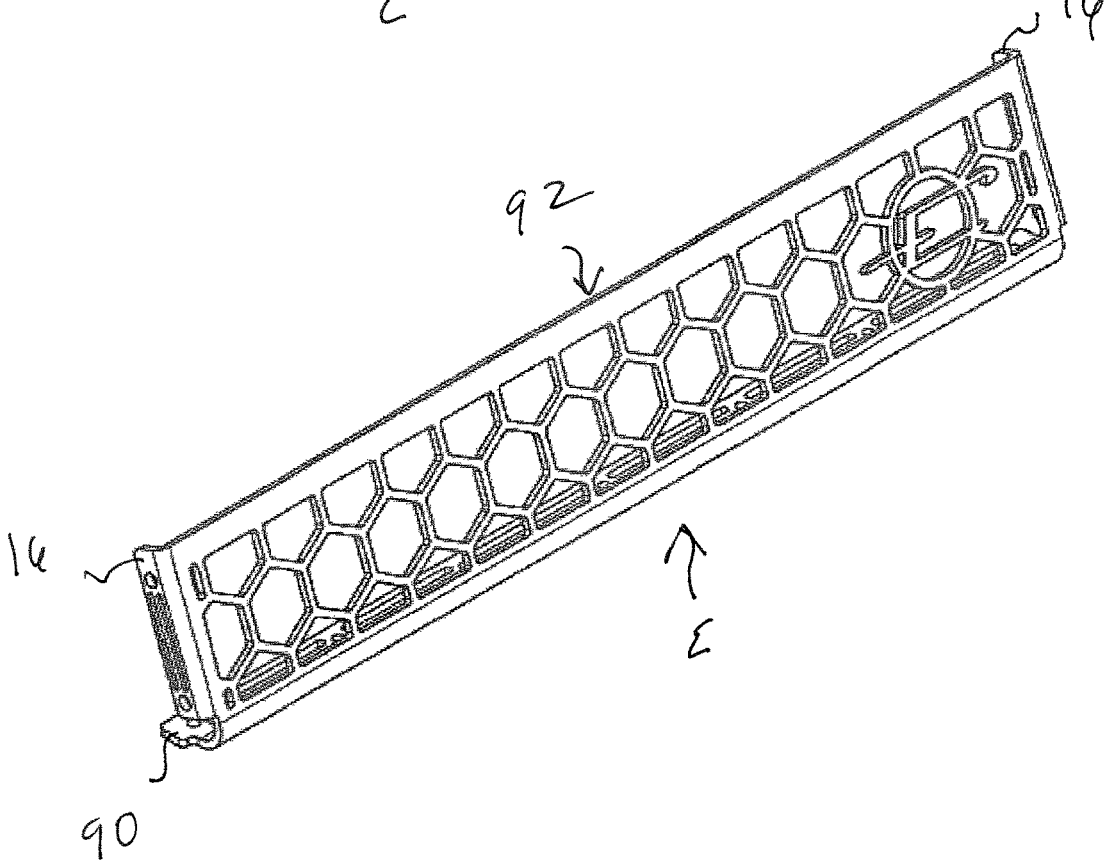
FIG. 21 is a rear perspective view of the rear support depicted in FIG. 18.

Female inserts 8, conical washers 10 and star screws 12 detachably connect each of legs C and D to rear support E. However, it is to be understood that any suitable fastener or connecting device or substance may be used to connect legs C and D to rear support E. Referring to FIG. 18, a pair of openings 14 are formed in each of the opposing ends flanges 16 of rear support E to receive corresponding portions of inserts 8 and star screws 12. Preferably, the left and right opposing end flanges 16 have the same configuration. Referring to FIGS. 14 and 17, each of legs C and D include two spaced openings 18 to receive corresponding portions of inserts 8 and star screws 12.

Figure 10:
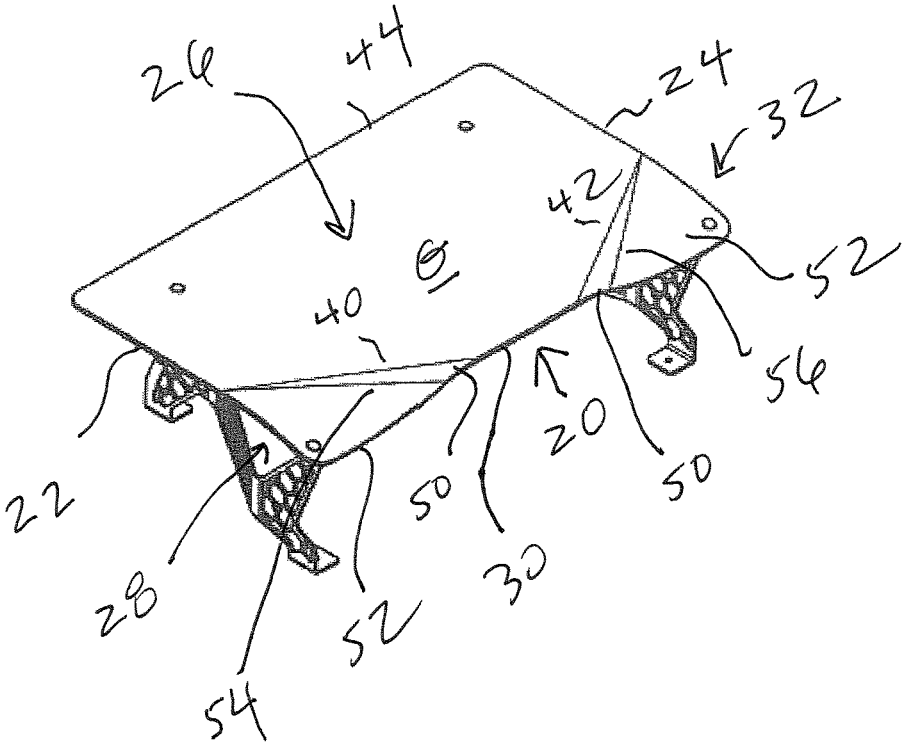
FIG. 10 is a top perspective view of the preferred form of the present invention depicted in FIG. 1.
Figure 11:
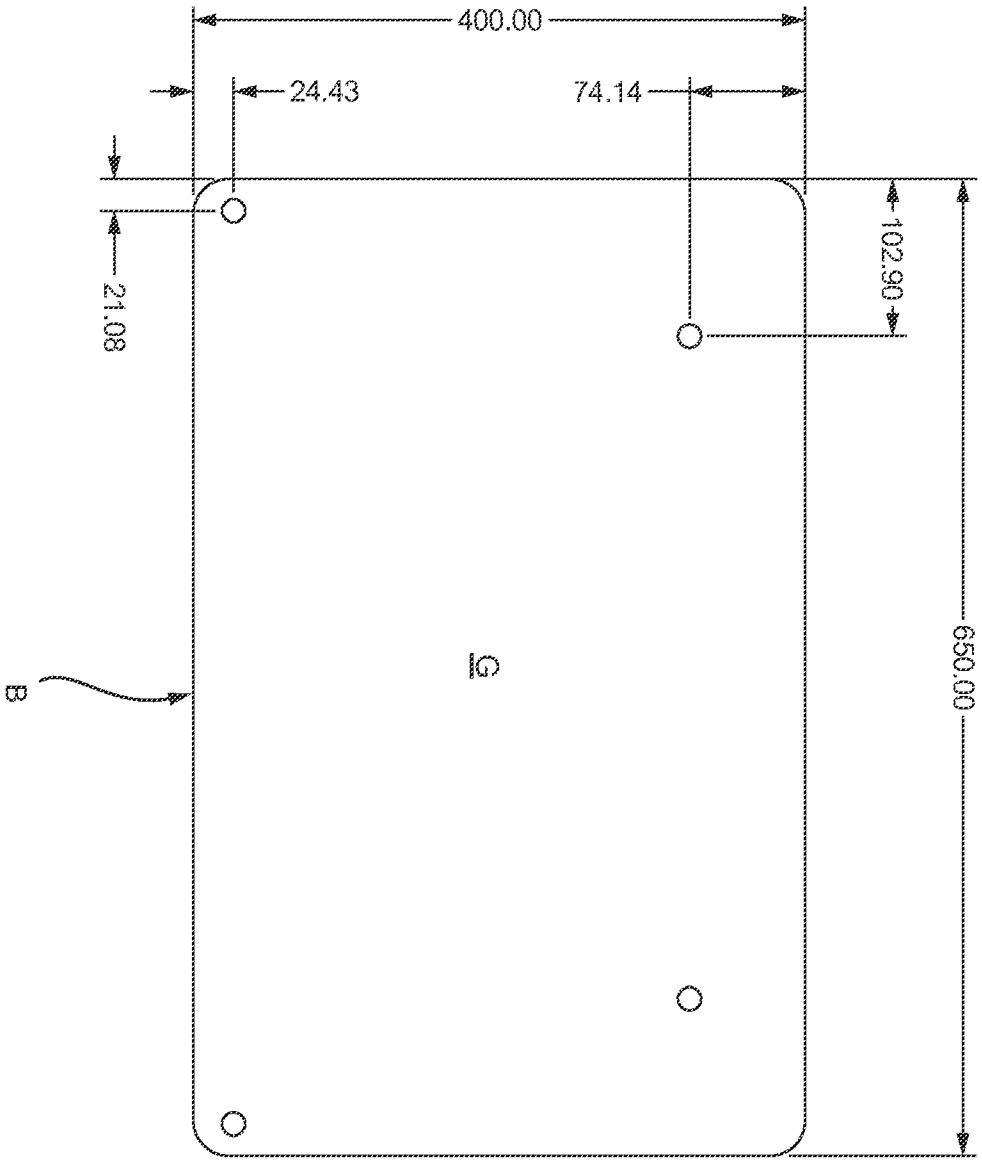
FIG. 11 is a plan view of a preferred form of work surface/top showing in millimeters several preferred dimensions.

Referring to FIG. 10, ergonomic top B includes a front section 20, a left side 22, a right side 24 and a rear section 26. Front section 20 includes a left portion 28, an intermediate portion 30 and a right portion 32. Intermediate portion 30 is disposed between left portion 28 and right portion 32. An upper surface of intermediate portion 30 of front section 20 of top B is disposed in a first horizontal plane. An upper surface of rear section 26 of top B is disposed in the first horizontal plane. Work surface G defined by a front edge of intermediate section 20, lines 40 and 42, the section of left side 22 extending rearwardly from the rear end of line 40, the section of right side 24 extending rearwardly from the rear end of line 42 and rear edge 44 preferably extends in the first horizontal plane. Work surface G preferably forms a major portion of the upper surface of top B.

Left portion 28 and right portion 32 include first and second segments 50 and 52. Referring to FIG. 10, segment 50 of left portion 28 is defined by lines 40 and 54. Segment 50 of right portion 32 is defined by lines 42 and 56. Segments 50 extend downwardly from the first horizontal plane as indicated by lines 40 and 42 and provide a smooth transition between work surface G and the corresponding segment 52.

Figure 22:
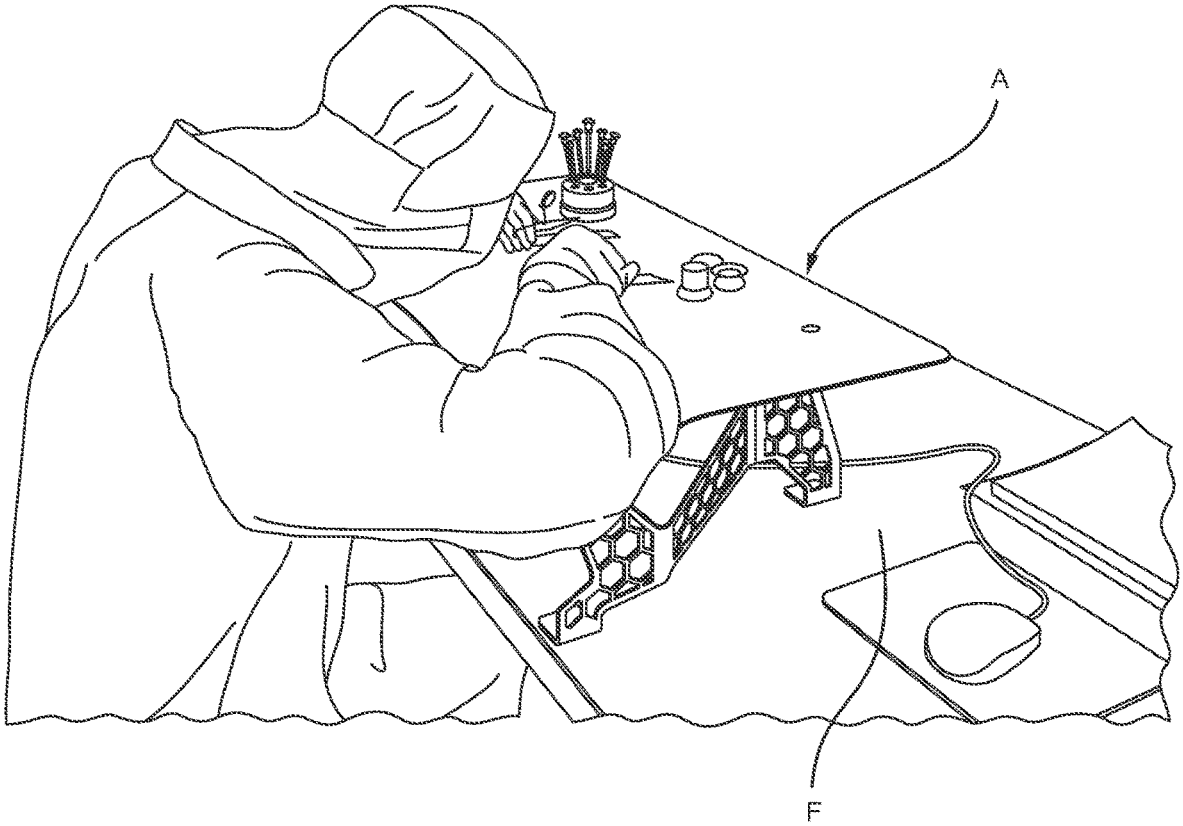
FIG. 22 is a perspective view of a user working with a table top work bench formed in accordance with a preferred embodiment of the present invention wherein the table top work bench is removably mounted on a top of a primary work structure.

Segments 52 provide an ergonomic resting surface for a corresponding portion of a user's arm (e.g., forearm). Lines 54 and 56 indicate the juncture at which segments 52 extend downwardly from the corresponding segment 50. As seen in FIG. 22, the user can rest his or her forearms on segments 52 and the work surface G is horizontally aligned with or near the face of the user. Also, when a user rests his or her arms on segments 52, the user's hands assume a position horizontally aligned with or near a user's face. Table top B therefore locates the object or objects being worked on close to the user's face with the user's hands being similarly located. This is particularly advantageous when the object being worked on is intricate (e.g., jewelry, watches, electronic components, etc.) Segments 50 and 52 preferably have a smooth upper surface which can be curved (e.g., convex). Further, the juncture of segments 50 with the corresponding segments 52 can be rounded or curved (e.g., convex) and the juncture of segments 50 and work surface G can be rounded or curved (e.g., convex).

Figure 12:
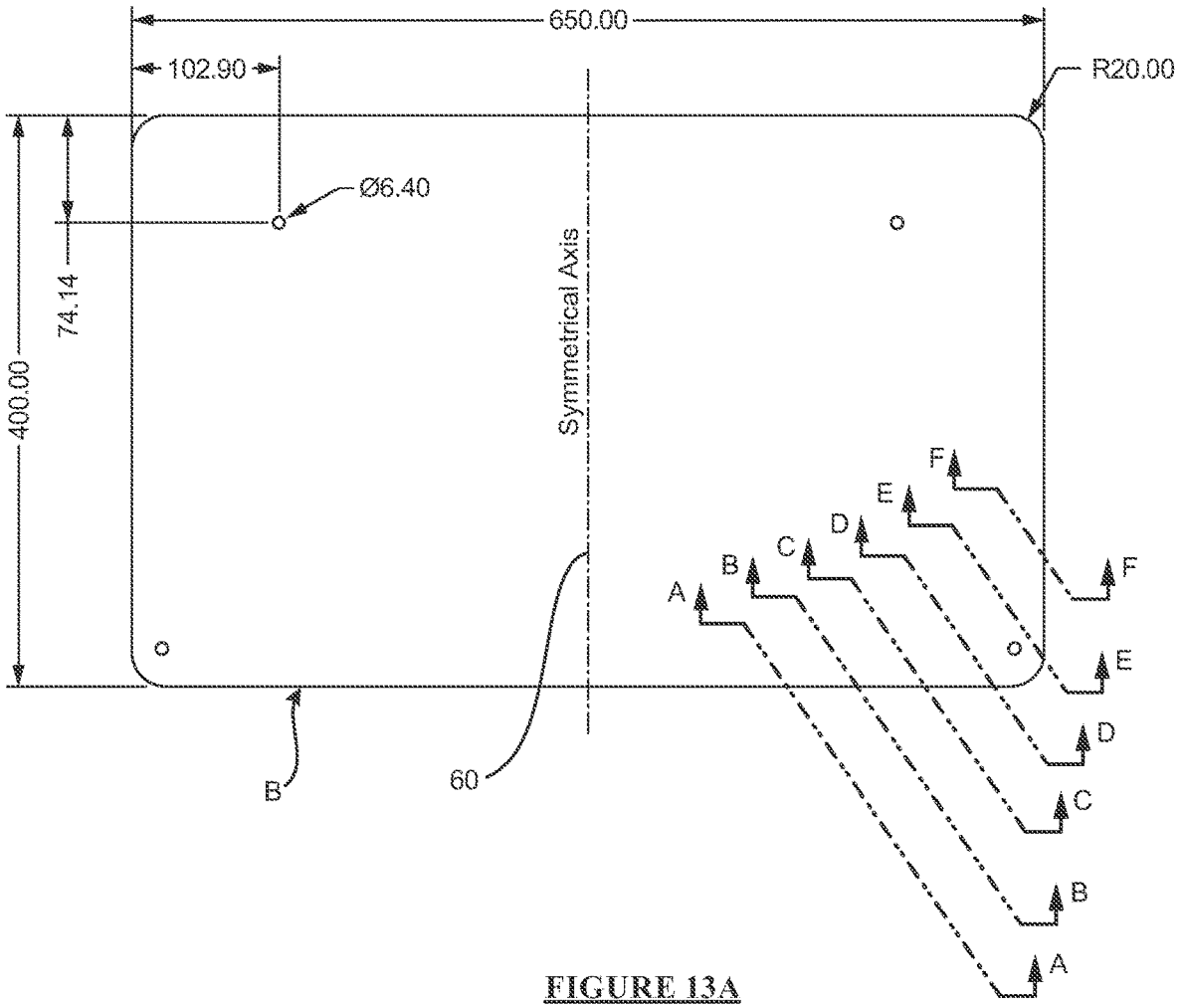
FIG. 12 is a plan view of a preferred form of work surface/top showing several preferred dimensions.
Figure 13A:
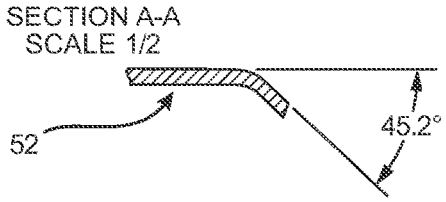
FIG. 13A is an enlarged sectional view taken along section A-A in FIG. 12.
Figure 13B:
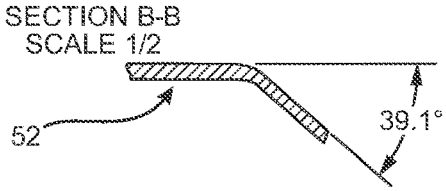
FIG. 13B is an enlarged sectional view taken along section B-B in FIG. 12.
Figure 13C:
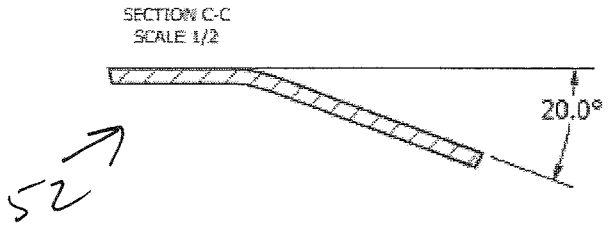
FIG. 13C is an enlarged sectional view taken along section C-C in FIG. 12.
Figure 13D:
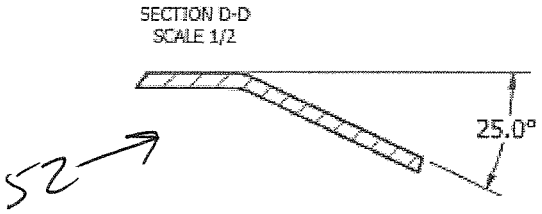
FIG. 13D is an enlarged sectional view taken along section D-D in FIG. 12.
Figure 13E:
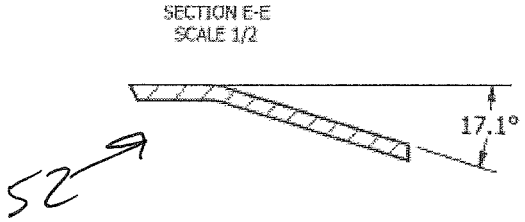
FIG. 13E is an enlarged sectional view taken along section E-E in FIG. 12.
Figure 13F:
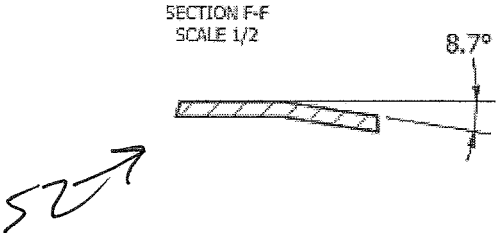
FIG. 13F is an enlarged sectional view taken along section F-F in FIG. 12.

Referring to FIG. 12, dashed line 60 represents a symmetrical axis. FIGS. 13A to 13F depict the preferred contour of right segment 52. The corresponding portions of left segment 52 are preferably similarly contoured.

Legs C and D include front lower feet 70 and rear lower feet 72 in addition to upper front feet 9 and upper rear feet 11. Rear lower feet 72, front lower feet 70 and rear upper feet 11 preferably extend parallel to the first horizontal plane while front upper feet 9 extend at an acute angle to the first horizontal plane. The front feet 9 of each of legs C and D are offset outwardly from the corresponding rear feet 11 of legs C and D.

Figure 16:
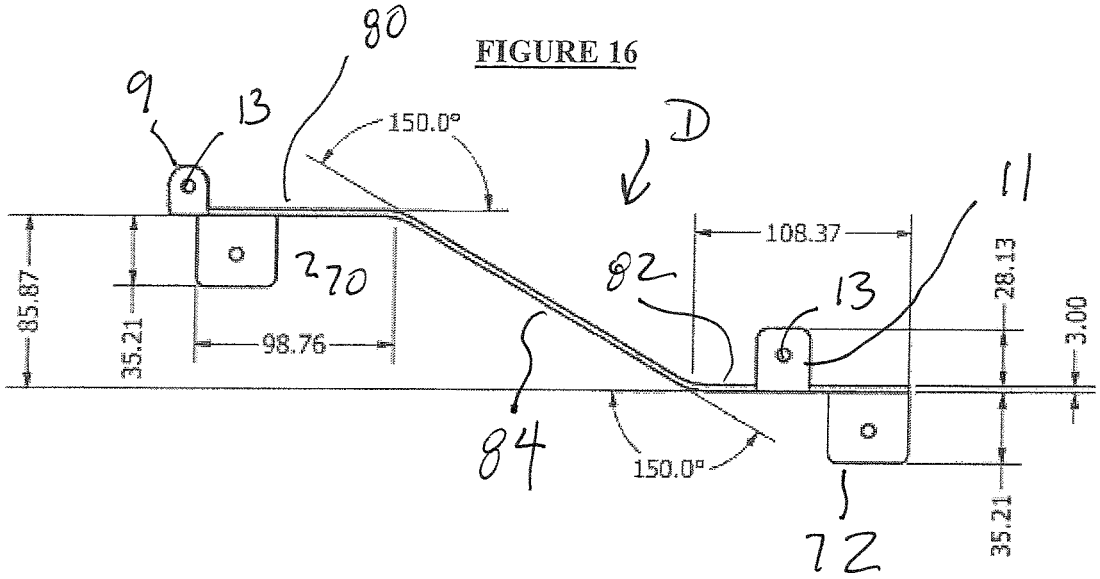
FIG. 16 is a plan view of a preferred form of the left leg showing several preferred dimensions.

Each of legs C and D have a similar configuration and, therefore, only one will be discussed in detail. Right leg or stand D includes a front section 80, a rear section 82 and an intermediate section 84. Front section 80 extends parallel to rear section 84 and intermediate section 84 forms an angle with each of sections 80 and 82 as seen in FIG. 16. Each of sections 80, 82 and 84 preferably include a honeycomb shape segment including a plurality of non-circular openings to reduce weight while maximizing strength.

Rear support E includes left and right end flanges 16, bottom flange 90 and a main body section 92. Main body section 92 preferably includes a honeycomb shape segment including a plurality of non-circular openings to reduce weight while maximizing strength.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

I claim:

1. An apparatus for supporting one or more objects in an elevated position that allows a user to access and work on the one or more objects, said apparatus comprising:

(a) a top forming an elevated work surface accessible to a user, said top including a front section, a rear section, a left side and a right side, said front section having a left portion, an intermediate portion and a right portion, the intermediate portion being disposed between said left portion and said right portion, said intermediate portion forming a first portion of a front edge of said top, said left portion of said front section forming a second portion of the front edge of said top and a front portion of said left side of said top and said right portion of said front section forming a third portion of the front edge of said top and a front portion of said right side of said top;

(b) an upper surface of said intermediate portion of said front section of said top being disposed in a first horizontal plane, an upper surface of said rear section of said top being disposed in said first horizontal plane, said left portion of said front section of said top and said right portion of said front section of said top each extending downwardly at an angle to said first horizontal plane to provide a resting surface for a corresponding portion of an individual's arm; and (c) said left portion and said right portion of said front section of said top each having a first segment, a second segment and a third segment, said first segment is disposed closer to said intermediate portion than either said second segment and said third segment and said second segment is disposed between said first segment and said third segment, said first segment forms a first angle with the first horizontal plane, said second segment forms a second angle with the first horizontal plane and said third segment forms a third angle with the first horizontal plane, wherein said first angle is between 48 degrees and 36 degrees, said second angle is between 22 degrees and 18 degrees, and said third angle is greater than said second angle but less than said first angle.

2. The apparatus of claim 1, wherein:

(a) said top is formed from hand laid carbon fiber.

3. The apparatus of claim 1, wherein:

(a) at least a major portion of said elevated work surface of said top is disposed in said first horizontal plane.

4. The apparatus of claim 1, further including:

(a) at least two legs, and each of said at least two legs includes two feet configured to be removably mounted on a work surface of a primary work apparatus; and, (b) each of said at least two legs having a height less than a height of each of one or more legs of the primary work apparatus.

5. The apparatus of claim 4, wherein:

(a) each of said at least two legs includes an upper front foot, a lower front foot, a rear upper foot and a rear lower foot, the upper front foot extends at an acute angle to the first horizontal plane and the upper rear foot extends parallel to the first horizontal plane.

6. The apparatus of claim 1, further including:

(a) at least two legs, and each of said at least two legs includes upper and lower front feet and upper and lower rear feet, the front feet of each of said at least two legs being offset outwardly from the corresponding rear feet of said at least two legs, said upper rear foot of each of said at least two legs extend in a plane parallel to said first horizontal plane and said upper front foot of each of said at least two legs extends at an acute angle to said first horizontal plane and said lower front foot and said lower rear foot of each of said at least two legs extend in a plane parallel to said first horizontal plane.

7. The apparatus of claim 6, wherein:

(a) said at least two legs are detachably connected to said top.

8. The apparatus of claim 1, wherein:

(a) all portions of said top have substantially the same thickness.

9. A portable work bench configured to be removably mounted on a work surface of a primary work apparatus having one or more legs for supporting the work surface of the primary work apparatus in a raised position, said portable work bench comprising:

(a) a top forming an elevated work surface offset upwardly from the work surface of the primary work apparatus, said top including a front section, a rear section, a left side and a right side, said front section having a left portion, an intermediate portion and a right portion, the intermediate portion being disposed between said left portion and said right portion, an upper surface of said intermediate portion of said front section of said top being disposed in a first horizontal plane, said left portion of said top and said right portion of said top each extending downwardly from said first horizontal plane to provide a resting surface for a corresponding portion of an individual's arm; and, (b) at least one leg for removably supporting said top of said portable work bench on the work surface of the primary work apparatus, said at least one leg of said portable work bench having a height less than a height of each of the one or more legs of the primary work apparatus wherein said at least one leg includes a first leg having an upper front foot, a lower front foot, an upper rear foot and a lower rear foot, the upper front foot extends at an acute angle to the first horizontal plane and the upper rear foot extends parallel to the first horizontal plane.

10. The portable work bench of claim 9, wherein:

(a) the at least one leg further includes a second leg, said second leg includes a front section having an upper foot and a lower foot, a rear section having an upper foot and a lower foot and an intermediate section extending from the front section to the rear section wherein the front section and the rear section extend parallel to each other and the intermediate section extends at an angle to said front section and said rear section and further wherein the upper foot of the front section extends at an acute angle to the first horizontal plane and the upper foot of the rear section extends parallel to the first horizontal plane.

11. The portable work bench of claim 10, wherein:

(a) said front section, said intermediate section and said rear section of said second leg each have a honeycomb shaped segment including a plurality of non-circular openings;

(b) said rear section of said second leg has a height greater than said front section of said second leg: and, (c) said upper foot of said front section of said second leg is detachably connected directly to said right portion of said front section of said top.

12. The portable work bench of claim 9, wherein:

(a) a major portion of said elevated work surface of said top is disposed in said first horizontal plane.

13. A portable work bench configured to be removably mounted on a work surface of a primary work apparatus having one or more legs for supporting the work surface of the primary work apparatus in a raised position, said portable work bench comprising:

(a) a top forming an elevated work surface offset upwardly from the work surface of the primary work apparatus, said top including a front section, a rear section, a left side and a right side, said front section having a left portion, an intermediate portion and a right portion, the intermediate portion being disposed between said left portion and said right portion, said intermediate portion of said front section of said top being disposed in a first horizontal plane, said left portion of said top and said right portion of said top each extending downwardly from said first horizontal plane to provide a resting surface for a corresponding portion of an individual's arm; and, (b) at least two legs for removably supporting said top of said portable work bench on the work surface of the primary work apparatus, said at least two legs of said portable work bench being detachably connected to said top of said portable work bench so that said portable work bench can be collapsed wherein each of said at least two legs includes a front foot and a rear foot, the front foot of each of said at least two legs is offset outwardly from the corresponding rear foot of said at least two legs.

14. The portable work bench of claim 13, wherein:

(a) each of said at least two legs includes a front section having an upper front foot and a lower front foot, a rear section having an upper rear foot and a lower rear foot and an intermediate section connecting the front section to the rear section wherein the front section and the rear section extend parallel to each other and the intermediate section extends at an angle to said front section and said rear section and further wherein the upper front foot of the front section of each of said at least two legs extends at an acute angle to the first horizontal plane and the upper rear foot of the rear section of each of said at two legs extends parallel to the first horizontal plane.

15. The portable work bench of claim 13, wherein:

(a) a major portion of said elevated work surface of said top is disposed in said first horizontal plane.

16. The portable work bench of claim 13, wherein:

(a) said left portion and said right portion of said front section of said top each having a first segment, a second segment and a third segment, said first segment being disposed closer to said intermediate portion than either said second segment and said third segment and said second segment is disposed between said first segment and said third segment, said first segment forms a first angle with the first horizontal plane, said second segment forms a second angle with the first horizontal plane and said third segment forms a third angle with the first horizontal plane, wherein said first angle is between 48 degrees and 36 degrees, said second angle is between 22 degrees and 18 degrees, and said third angle is greater than said second angle but less than said first angle.

17. The portable work bench of claim 13, wherein:

(a) said top is formed from a rigid material so that when an individual rests an arm on a corresponding portion of said top, said top remains in the same position prior to the individual resting the arm on the corresponding portion of said top.

18. The portable work bench of claim 17, wherein:

(c) all portions of said top have substantially the same thickness.

* * * * *